US011547148B2

(12) United States Patent
Lee et al.

(10) Patent No.: US 11,547,148 B2
(45) Date of Patent: Jan. 10, 2023

(54) AEROSOL GENERATING DEVICE HAVING A MAGNETIC FORCE GENERATOR FOR COUPLING A CASE WITH A COVER

(71) Applicant: KT&G CORPORATION, Daejeon (KR)

(72) Inventors: Seung Won Lee, Seoul (KR); Jae Min Lee, Seoul (KR); In Seoung Chun, Seoul (KR); Sung Rok Oh, Seoul (KR); Kyung Moon Ji, Seoul (KR)

(73) Assignee: KT&G CORPORATION, Daejeon (KR)

( * ) Notice: Subject to any disclaimer, the term of this patent is extended or adjusted under 35 U.S.C. 154(b) by 276 days.

(21) Appl. No.: 16/648,335

(22) PCT Filed: Oct. 29, 2018

(86) PCT No.: PCT/KR2018/012880
§ 371 (c)(1),
(2) Date: Mar. 18, 2020

(87) PCT Pub. No.: WO2019/088605
PCT Pub. Date: May 9, 2019

(65) Prior Publication Data

US 2020/0214355 A1 Jul. 9, 2020

(30) Foreign Application Priority Data

Nov. 6, 2017 (KR) ..... 10-2017-0146974
Jan. 22, 2018 (KR) ..... 10-2018-0007797
Oct. 8, 2018 (KR) ..... 10-2018-0119997

(51) Int. Cl.
*A24F 40/50* (2020.01)
*A24F 40/40* (2020.01)
(Continued)

(52) U.S. Cl.
CPC ..... *A24F 40/50* (2020.01); *A24F 40/46* (2020.01); *A24F 40/60* (2020.01)

(58) Field of Classification Search
CPC ..... A24F 40/40; A24F 40/465; A24F 40/20; A24F 40/50
See application file for complete search history.

(56) References Cited

U.S. PATENT DOCUMENTS 8,430,089 B2 4/2013 Kim et al.
9,486,014 B2 11/2016 Liu
(Continued)

FOREIGN PATENT DOCUMENTS

CN 103355745 A 10/2013
CN 203234036 U 10/2013
(Continued)

OTHER PUBLICATIONS

Int. Search Report dated May 20, 2019 issued by the Int. Searching Authority in Application No. PCT/KR2018/012880 (PCT/ISA/210).
(Continued)

*Primary Examiner* — Hae Moon Hyeon
(74) *Attorney, Agent, or Firm* — Sughrue Mion, PLLC

(57) ABSTRACT

An aerosol generating device includes a case, a cover having a metallic body and configured to be coupled to the case, a heater configured to heat an aerosol generating material, a magnetic force generator arranged in the case and configured to generate magnetic force acting on the metallic body according to a current applied thereto, and a controller configured to adjust coupling force between the cover and the case arising, which is generated by the magnetic force, by controlling the current applied to the magnetic force generator based on an operating state of the heater.

15 Claims, 10 Drawing Sheets

(51) Int. Cl.
*A24F 40/60* (2020.01)
*A24F 40/46* (2020.01)

(56) References Cited

U.S. PATENT DOCUMENTS

| | | | | |
|---|---|---|---|---|
| 10,070,667 | B2 | 9/2018 | Lord et al. | |
| 10,342,260 | B2 | 7/2019 | Thorens et al. | |
| 11,154,091 | B2 | 10/2021 | Reevell | |
| 2013/0042865 | A1 | 2/2013 | Monsees et al. | |
| 2014/0060528 | A1 | 3/2014 | Liu | |
| 2017/0042238 | A1 | 2/2017 | Murison et al. | |
| 2017/0119044 | A1 | 5/2017 | Oligschlaeger et al. | |
| 2017/0188636 | A1 | 7/2017 | Li et al. | |
| 2020/0008471 | A1 | 1/2020 | Reevell | |
| 2020/0154789 | A1* | 5/2020 | Novak, III | H02J 7/0031 |
| 2021/0015158 | A1* | 1/2021 | Moloney | A24F 40/65 |
| 2021/0022396 | A1* | 1/2021 | Lee | A24F 40/40 |

FOREIGN PATENT DOCUMENTS

| | | | |
|---|---|---|---|
| CN | 103519352 | A | 1/2014 |
| CN | 106998814 | A | 8/2017 |
| CN | 109068754 | A | 12/2018 |
| JP | 2019-520044 | A | 7/2019 |
| KR | 19990031883 | U | 7/1999 |
| KR | 101085901 | B1 | 11/2011 |
| KR | 20-2014-0006242 | U | 12/2014 |
| KR | 101523089 | B1 | 5/2015 |
| KR | 10-2016-0026464 | A | 3/2016 |
| KR | 10-2016-0040643 | A | 4/2016 |
| KR | 20-2016-0001171 | A | 4/2016 |
| WO | 2016/141555 | A1 | 9/2016 |
| WO | 2017/207435 | A1 | 12/2017 |

OTHER PUBLICATIONS

Written Opinion dated May 20, 2019 issued by the Int. Searching Authority in Application No. PCT/KR2018/012880 (PCT/ISA/237).
Notice of Reasons for Refusal dated Apr. 6, 2021 from the Japanese Patent Office in JP Application No. Machine 2020-516531.
Extended European Search Report dated Jul. 20, 2021 in Application No. 18872139.3.
Communication dated Jul. 25, 2022 from the Chinese Patent Office in Chinese Application No. 201880059279.7.

* cited by examiner

AEROSOL GENERATING DEVICE HAVING A MAGNETIC FORCE GENERATOR FOR COUPLING A CASE WITH A COVER

CROSS REFERENCE TO RELATED APPLICATIONS

This application is a National Stage of International Application No. PCT/KR2018/012880 filed Oct. 29, 2018, claiming priority based on Korean Patent Application No. 10-2017-0146974 filed Nov. 6, 2017, on Korean Patent Application No. 10-2018-0007797 filed Jan. 22, 2018, and Korean Patent Application No. 10-2018-0119997 filed Oct. 8, 2018.

TECHNICAL FIELD

The present disclosure disclosed by the present application relates to an aerosol generating device and an operation method thereof, and more specifically, to an aerosol generating device for adjusting coupling force between a cover and a case by using magnetic force, and an operation method thereof.

BACKGROUND ART

Recently, the demand for alternative methods to overcome the shortcomings of general cigarettes has increased. For example, there is an increasing demand for a method of generating aerosol by heating an aerosol generating material in cigarettes, rather than by burning cigarettes. Accordingly, studies on a heating-type cigarette and a heating-type aerosol generating device have been actively conducted.

While an aerosol generating device as described above is being heated, there exists a safety risk such as burning of a user's skin when a part of the aerosol generating device or a cigarette heated to a high temperature is exposed to the outside due to factors such as inexperienced handling, a user's carelessness, operational mistakes, etc. Therefore, there is a need for methods of securing user safety by preventing a heater from being opened when an aerosol generating material is heated.

DESCRIPTION OF EXEMPLARY EMBODIMENTS

Technical Problem

An objective of the present disclosure is to provide an aerosol generating device capable of controlling coupling force of a cover by using magnetic force, and an operation method thereof.

Another objective of the present disclosure is to provide an aerosol generating device for controlling a current applied to a coil to heat an aerosol generating material or control the coupling force of the cover, and an operation method thereof.

The objective to be solved by the present disclosure is not limited to the objectives described above, and objectives that are not mentioned above will be clearly understood by those of ordinary skill in the art from the present specification and the accompanying drawings.

Solution to Problem

An aerosol generating device according to an exemplary embodiment includes a case, a cover having a metallic body and configured to be coupled to the case, a heater configured to heat an aerosol generating material, a magnetic force generator arranged in the case and configured to generate a magnetic force acting on the metallic body according to a current applied thereto, and a controller configured to adjust coupling force between the cover and the case, which is generated by the magnetic force, by controlling the current applied to the magnetic force generator based on an operating state of the heater.

Also, when the heater heats the aerosol generating material, the controller may control the current applied to the magnetic force generator to strengthen the coupling force.

Also, when the heater does not heat the aerosol generating material, the controller may control the current applied to the magnetic force generator to weaken the coupling force.

Also, when the heater heats the aerosol generating material, the controller may apply a current having a first current value to the magnetic force generator, and when the heater does not heat the aerosol generating material, may apply a current having a second current value smaller than the first current value to the magnetic force generator.

Also, the second current value may be 0.

Also, the aerosol generating device may further include an input unit configured to receive a user input for generating aerosol, and when the user input is received through the input unit, the controller may apply a current to the magnetic force generator and then operate the heater.

Also, when a certain condition is satisfied, the controller may stop applying the current to the magnetic force generator to facilitate separation of the cover and the case.

Also, when the condition is satisfied, the controller may stop a heating operation of the heater and then stop applying the current to the magnetic force generator.

Also, the aerosol generating device may further include a puff sensor configured to sense a user's puffs, and the condition may be that the number of a user's puffs, detected through the puff sensor, exceeds a preset puff limit.

Also, the condition may be that a time of a heating operation of the heater exceeds a preset time limit.

Also, the aerosol generating device may further include an input unit configured to receive a user input, and the condition may be that a user input for stopping heating is received through the input unit.

Also, the aerosol generating device may further include a temperature sensor configured to measure a temperature of the heater, and the condition may be that, after a heating operation of the heater is stopped, a temperature of the heater descends to below a preset temperature limit.

Also, the aerosol generating device may further include an input unit configured to receive a user input, and when the heater heats the aerosol generating material, the controller may apply a current to the magnetic force generator, and may reheat the heater while maintaining the current applied to the magnetic force generator when the user input for generating aerosol is received through the input unit, after a heating operation of the heater is stopped but before a temperature of the heater that descends to below a preset temperature limit.

Also, the condition may be that a preset standby time elapses after a heating operation of the heater is stopped.

Also, the aerosol generating device may further include an input unit configured to receive a user input, and when the heater heats the aerosol generating material, the controller may apply a current to the magnetic force generator, and may reheat the heater while maintaining the current applied to the magnetic force generator when the user input for generating aerosol is received through the input unit, after a heating operation of the heater is stopped but before a preset standby time elapses.

Also, the heater may be arranged on one upper side of the case, the magnetic force generator may be arranged on another upper side of the case, and the metallic body may be provided on one side of the cover which faces the other upper side of the case when the cover is coupled to an upper portion of the case.

An aerosol generating device according to another exemplary embodiment includes a case, a cover having a metallic body and configured to be coupled to the case, a coil arranged in the case and configured to, according to a current applied, generate an induced current in a susceptor to heat an aerosol generating material, or generate magnetic force acting on the metallic body, and a controller configured to adjust coupling force between the cover and the case which is generated by the magnetic force, and a heating state of the aerosol generating material, by controlling the current applied to the coil.

Also, the controller may adjust the coupling force between the cover and the case based on the heating state of the aerosol generating material.

Also, when the aerosol generating material is being heated, the controller may generate magnetic force through the coil to strengthen the coupling force between the cover and the case.

An operation method of an aerosol generating device according to another exemplary embodiment is an operation method of an aerosol generating device including a case and a cover couplable to the case, wherein the aerosol generating device includes a metallic body provided in the cover and a magnetic force generator provided in the case and configured to generate magnetic force acting on the metallic body according to a current applied thereto, the operation method including applying a first current to the magnetic force generator to strengthen coupling force between the cover and the case when the aerosol generating material is heated, and applying a second current smaller than the first current to the magnetic force generator to weaken the coupling force, when the aerosol generating material is not heated.

Also, the operation method of the aerosol generating device may further include receiving a user input for heating the aerosol generating material, applying a current to the magnetic force generator to strengthen the coupling force between the cover and the case, and heating the aerosol generating material after applying the current.

The means for solving problems of the present disclosure is not limited to the means for solving problems described above, and means for solving problems that are not mentioned above will be clearly understood by those of ordinary skill in the art from the present specification and the accompanying drawings.

Advantageous Effects of Disclosure

According to the present disclosure, a user's injury caused in relation to heating of an aerosol generating material may be prevented by adjusting coupling force of a cover by using magnetic force.

Also, according to the present disclosure, an aerosol generating device may be simply and directly designed by providing a coil which heats the aerosol generating material or adjusts the coupling force of the cover.

The advantageous effect of the present disclosure is not limited to the advantageous effects described above, and advantageous effects that are not mentioned above will be clearly understood by those of ordinary skill in the art from the present specification and the accompanying drawings.

BEST MODE

Figure 1:
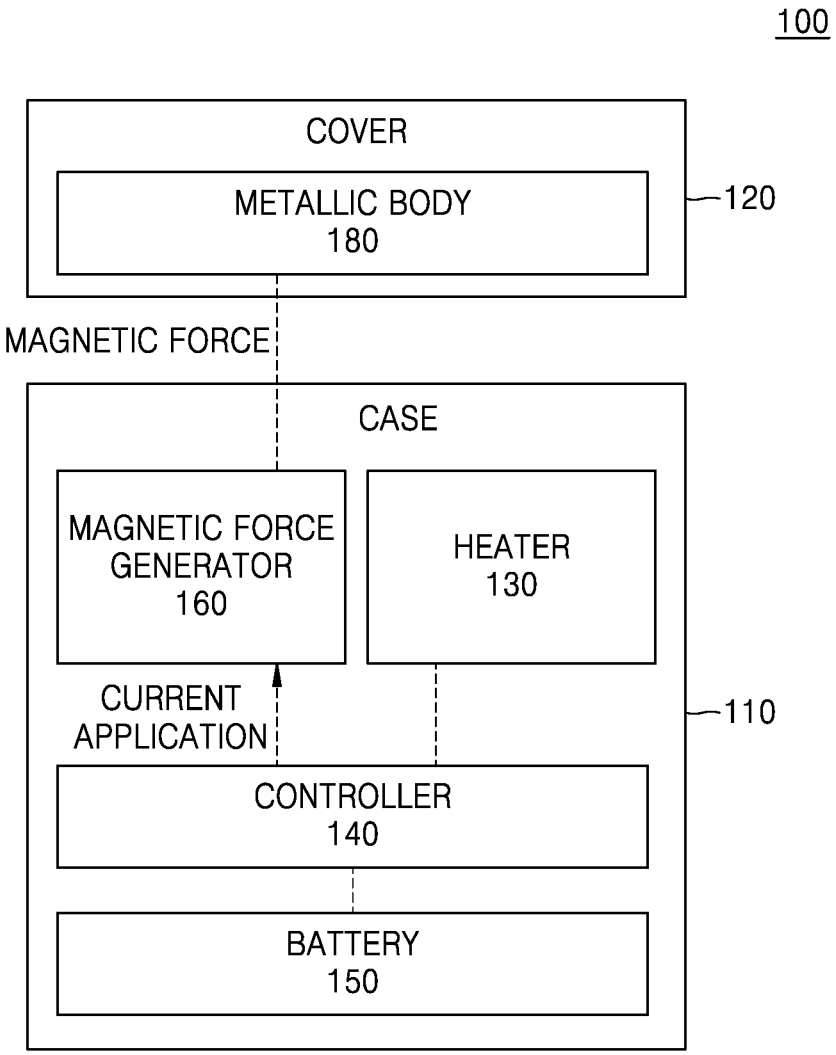
FIG. 1 is a block diagram of an aerosol generating device according to an exemplary embodiment.

An aerosol generating device according to an exemplary embodiment includes a case, a cover having a metallic body and being couplable to the case, a heater configured to heat an aerosol generating material, a magnetic force generator arranged in the case and configured to generate magnetic force acting on the metallic body according to a current applied thereto, and a controller configured to adjust coupling force between the cover and the case, which is generated by the magnetic force, by controlling the current applied to the magnetic force generator based on an operating state of the heater.

An aerosol generating device according to another exemplary embodiment includes a case, a cover having a metallic body and being couplable to the case, a coil arranged in the case and configured to generate an induced current in a susceptor according to a current applied to heat an aerosol generating material, or generate magnetic force acting on the metallic body, and a controller configured to adjust coupling force between the cover and the case arising due to the magnetic force and a heating state of the aerosol generating material by controlling the current applied to the coil.

An operation method of an aerosol generating device according to another exemplary embodiment is an operation method of an aerosol generating device including a case and a cover couplable to the case, wherein the aerosol generating device includes a metallic body in the cover and a magnetic force generator, in the case, which generates magnetic force for the metallic body according to a current applied thereto, the operation method including applying a first current to the magnetic force generator to strengthen coupling force between the cover and the case when the aerosol generating material is heated, and applying a second current, which is smaller than the first current, to the magnetic force generator to weaken the coupling force when the aerosol generating material is not heated.

Mode of Disclosure

With respect to the terms in the various exemplary embodiments, the general terms which are currently and widely used are selected in consideration of functions of structural elements in the various exemplary embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various exemplary embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure can, however, be embodied in many different forms and should not be construed as being limited to the exemplary embodiments set forth herein.

Throughout the specification, the term "aerosol generating material" may refer to a material which can generate aerosol, and may also refer to an aerosol forming substrate. The aerosol may include a volatile compound. The aerosol generating material may be solid or liquid. For example, a solid aerosol generating material may include solid materials based on tobacco raw materials such as tobacco sheet cigarettes, pipe tobaccos, reconstituted cigarettes, etc., and a liquid aerosol generating material may include liquid materials based on nicotine, tobacco extracts, and various flavoring agents. However, the present disclosure is not limited to the above examples.

Throughout the specification, the aerosol generating device may be a device for generating aerosol by using an aerosol generating material in order to generate aerosol which can be directly inhaled into a user's lungs through a user's mouth. For example, the aerosol generating device may be a holder.

Throughout the specification, the term "puff" may refer to inhalation of the user, and the inhalation may refer to a situation in which the user draws air into the user's oral cavity, nasal cavity, or lungs via the user's mouth or nose.

Exemplary embodiments of the present disclosure will be described in detail hereinafter with reference to the accompanying drawings so that one of ordinary skill in the art would be able to readily implement the present disclosure. The present disclosure is not limited to the exemplary embodiments set forth herein and may be implemented in different forms.

Hereinafter, exemplary embodiments of the present disclosure will be described in detail with reference to the drawings.

FIG. 1 is a block diagram of an aerosol generating device according to an exemplary embodiment.

Referring to FIG. 1, the aerosol generating device 100 may include a case 110, a cover 120, a heater 130, a magnetic force generator 160, a battery 150, a controller 140, and a metallic body 180 provided in the cover 120.

In the aerosol generating device 100 illustrated in FIG. 1, only elements related to the present exemplary embodiment are shown. Therefore, it will be understood by those of ordinary skill in the art that other general elements besides the elements illustrated in FIG. 1 may be further included in the aerosol generating device 100.

The aerosol generating device 100 may heat the heater 130, and an aerosol generating material may be vaporized by the heater 130 to generate aerosol. The generated aerosol is delivered to the user by a user's inhalation.

The case 110 forms a part of an external appearance of the aerosol generating device 100, and functions to accommodate and protect various elements therein.

The case 110 may include the magnetic force generator 160.

Referring to FIG. 1, the case 110 is illustrated as having the magnetic force generator 160, the heater 130, the controller 140, and the battery 150. However, the order and arrangement of the magnetic force generator 160, the heater 130, the controller 140, and the battery 150 illustrated in FIG. 1 may be changed according to the design of the aerosol generating device 100. For example, the arrangement of each element is not limited to the inside of the case 110, but may be changed to be arranged outside the case 110, or to be arranged inside or outside the cover 120.

The cover 120 may be coupled to or separated from the case 110.

The case 110 and the cover 120 together form the external appearance of the aerosol generating device 100. The cover 120 may be coupled to the case 110 to protect internal elements of the aerosol generating device 100.

When the cover 120 is coupled to the case 110, the cover 120 may prevent heat generated from the heater 130 from being transferred to the outside of the aerosol generating device 100. Accordingly, it is possible to prevent injuries that may occur due to a user inadvertently contacting the heater 130 directly or touching an area of the case 110 heated by the heater 130 during an operation of the heater 130.

Also, when the cover 120 is coupled to the case 110, the cover 120 may fix the aerosol generating material inserted into and accommodated in the case 110, and thus may prevent the aerosol generating material from being separated from and falling out of the case 110.

When the cover 120 is separated from the case 110, an area of the case 110 that is blocked by the cover 120 while the cover 120 is combined with the case 110 may be exposed to the outside. Accordingly, cleaning of residues of the aerosol generating material or the like may be easily performed.

The cover 120 may include the metallic body 180.

Attractive force may be applied to the metallic body 180 in the direction of the magnetic force generator 160 by magnetic force (magnetism) generated by the magnetic force generator 160.

The magnetic force generated by the magnetic force generator 160 may act on the metallic body 180, and thus the coupling force between the cover 120 and the case 110 may be changed. When the magnetic force is increased, the coupling force between the cover 120 and the case 110 may be strengthened, and when the magnetic force is weakened, the coupling force between the cover 120 and the case 110 may be weakened. Accordingly, for the convenience of users or for safety reasons, the cover 120 may be strongly coupled to the case 110, or the cover 120 may be separated from the case 110.

The heater 130 may be heated by power supplied from the battery 150 to thereby heat and vaporize the aerosol generating material.

The heater 130 may be any type of heater which can heat aerosol up to a desired temperature for vaporizing aerosol. The desired temperature may be set in the aerosol generating device 100 in advance, or may be set by a user.

According to an exemplary embodiment, the aerosol generating device 100 may temporarily stop a heating operation of the heater 130 or supply a current supplied to the heater 130 in a waveform form in order to maintain the temperature of the heater 130 at a proper temperature.

According to an exemplary embodiment, when an aerosol generating material is contained in a cigarette, the cigarette may be inserted into the aerosol generating device 100. The heater 130 may be positioned inside or outside the cigarette to heat the aerosol generating material.

According to an exemplary embodiment, when the aerosol generating material is provided in a liquid cartridge, the aerosol generating material may be stored in a storage unit (not shown) of a cartridge (not shown). The storage unit may transfer the stored aerosol generating material to an atomizer (not shown) along a capillary wick by using surface tension. The heater 130 may be provided in the atomizer to heat the aerosol generating material.

According to an exemplary embodiment, the heater 130 may be an electric resistive heater. For example, the heater 130 may include an electrically conductive track, and the heater 130 may be heated as a current flows in the electrically conductive track.

According to an exemplary embodiment, the heater 130 may be an inductive heating-type heater. In detail, the heater 130 may include an electrically conductive coil 260 for heating the aerosol generating material by using inductive heating, and the cigarette or liquid cartridge may include a susceptor 320 which can be heated by the inductive heating-type heater.

The magnetic force generator 160 may generate magnetic force (magnetism) according to a command of the controller 140, and may adjust a magnitude of the magnetic force. The magnetic force generated by the magnetic force generator 160 may act as an attractive force on the metallic body 180 provided in the cover 120.

The magnetic force generator 160 may generate magnetic force when a current is applied thereto. According to an exemplary embodiment, the magnitude of the magnetic force generated by the magnetic force generator 160 may be proportional to a magnitude of the current applied. The magnetic force generator 160 may no longer generate the magnetic force when the current applied is stopped.

The magnetic force generator 160 may be any electronic device which generates a magnetic force by a current. For example, the magnetic force generator 160 may be a solenoid coil, an electromagnet holder, a bipolar electromagnet having both poles provided on one surface thereof together, a unipolar electromagnet having only one pole provided on one surface thereof, a bobbin electromagnet manufactured by winding a coil on an insulator, etc.

The battery 150 supplies power used to operate the aerosol generating device 100. For example, the battery 150 may supply power to heat the heater 130, and may supply power required to operate the controller 140. The battery 150 may supply a current to the magnetic force generator 160 according to a command of the controller 140 such that the magnetic force generator 160 may generate magnetic force. Also, the battery 150 may supply power required to operate a display, a sensor, a motor, etc. installed in the aerosol generating device 100.

The aerosol generating device 100 and an additional cradle may form together a system. For example, the cradle may be used to charge the battery 150 of the aerosol generating device 100. Alternatively, the heater 130 may be heated when the cradle and the aerosol generating device 100 are coupled to each other.

The controller 140 controls an overall operation of the aerosol generating device 100. In detail, the controller 140 controls operations of other elements included in the aerosol generating device 100 as well as operations of the battery 150, the heater 130, and the magnetic force generator 160. Also, the controller 140 may determine whether the aerosol generating device 100 is in an operable state by checking a state of each element of the aerosol generating device 100.

The controller 140 may control an operation of the magnetic force generator 160. The controller 140 may control the operation of the magnetic force generator 160 by controlling a current applied to the magnetic force generator 160.

The controller 140 may control the operation of the magnetic force generator 160 based on an operating state of the heater 130. When the heater 130 operates, the controller 140 may operate the magnetic force generator 160 or may strengthen the magnetic force generated by the magnetic force generator 160, such that the cover 120 is coupled to the case 110 more strongly. When the heater 130 does not operate, the controller 140 may stop the operation of the magnetic force generator 160 or may weaken the magnetic force generated by the magnetic force generator 160, such that the cover 120 is easily separable from the case 110. A method, performed by the controller 140, of operating the heater 130 and the magnetic force generator 160 will be described later in more detail.

The controller 1400 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The aerosol generating device 100 may further include general-purpose components in addition to the battery 150, the controller 140, and the heater 130. For example, the aerosol generating device 100 may include a display capable of outputting visual information, a motor for outputting haptic information, and/or charging contact for charging battery. For example, the motor may notify through vibration that the heating of the heater 130 is completed. For example, the aerosol generating device 100 may comprise an LED and display an operating state of the heater 130 through the LED.

Figure 10:
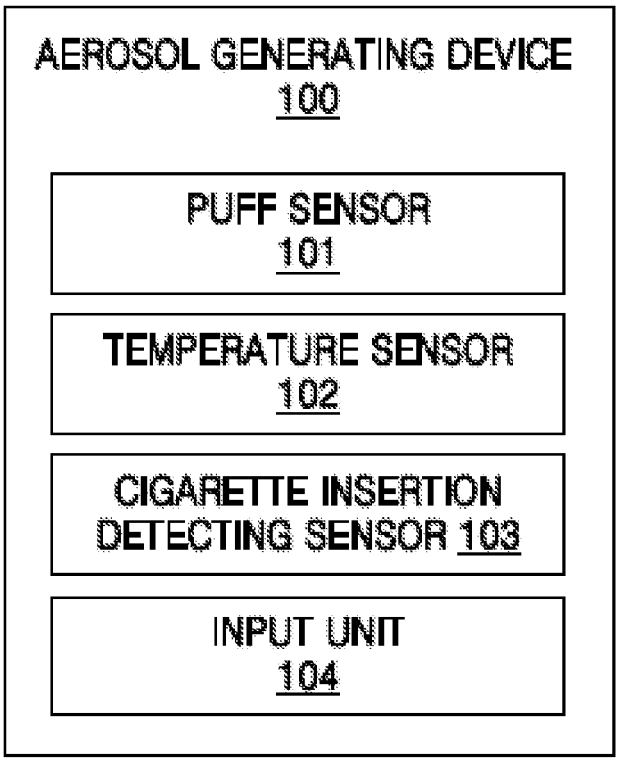
FIG. 10 is a block diagram that illustrates an aerosol generating device, and components that may be included therein, according to exemplary embodiments of the present application.

Also, with reference to FIG. 10, the aerosol generating device 100 may include at least one sensor (a puff sensor 101 (also referred to as a puff detecting sensor), a temperature sensor 102 (also referred to as a temperature detecting sensor), a cigarette insertion detecting sensor 103, etc.).

The puff sensor 101 may detect puffs in various ways. For example, the puffs may be detected by comparing and analyzing a difference between a temperature of introduced air and a temperature inside the aerosol generating device 100. Alternatively, the puff sensor 101 may detect the puffs by detecting a change in an air flow inside the aerosol generating device 100, caused by a user's puffs. Alternatively, the puff sensor 101 may detect the puffs by a change in resistance of the electrically conductive track that constitutes the heater 130. Alternatively, the puff sensor 101 may detect the user's puffs based on a change in a voltage level of the heater 130.

The controller 140 may determine the presence of a user's puffs and strengths of the puffs through the puff sensor 101, and may count the number of the puffs.

Also, the aerosol generating device 100 may include an input unit 104 (refer to FIG. 10). As the input unit 104 is manipulated, the operation of the aerosol generating device 100 may be controlled. For example, the aerosol generating device 100 may receive various inputs through the input unit 104, such as an input for starting a heating operation, an input for stopping the heating operation, a heating intensity, a heating time, and an intensity of magnetic force generated by the magnetic force generator. The input unit 104 may be, for example, a button, a switch, or a touch screen installed on an external surface of the case 110.

Figure 2:
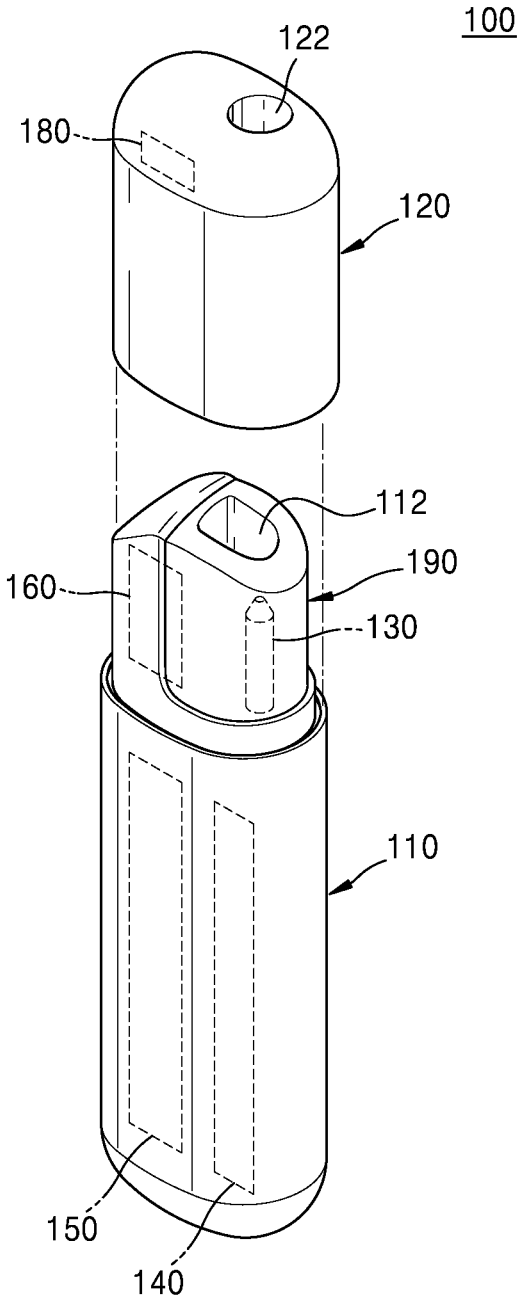
FIG. 2 is a perspective view of an aerosol generating device in which a cover is separated from a case, according to an exemplary embodiment.

FIG. 2 is a perspective view of an aerosol generating device in which a cover is separated from a case, according to an exemplary embodiment.

Figure 3:
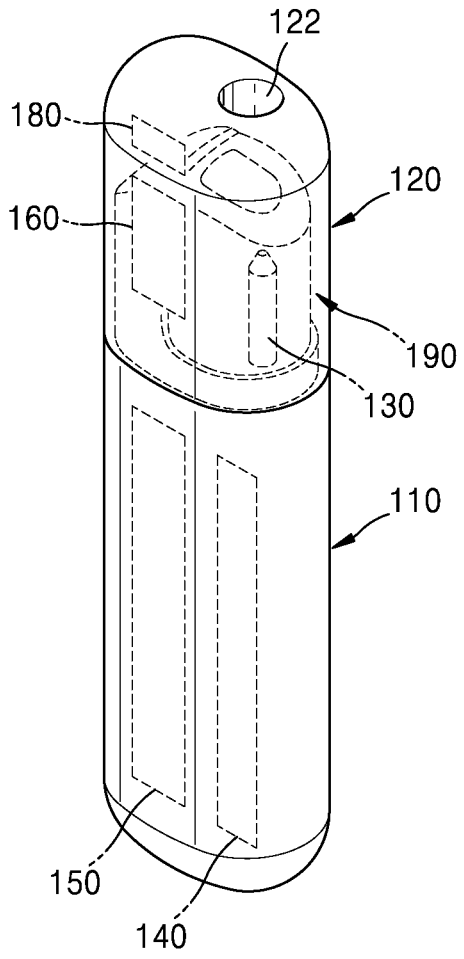
FIG. 3 is a perspective view of an aerosol generating device in which a cover is coupled to a case, according to an exemplary embodiment.

Although FIGS. 2 and 3 illustrate the aerosol generating device 100 in a case where the aerosol generating material is contained in a cigarette, the following descriptions made under the assumption that the aerosol generating material is provided in the form of a cigarette may be applied to a case where the aerosol generating material is stored in a liquid cartridge.

Referring to FIG. 2, in a state where the cover 120 is separated from the case 110, an internal space of the aerosol generating device 100, the heater 130, etc. may be exposed to the outside. Accordingly, a user who finished smoking a cigarette may separate the cigarette from the aerosol generating device 100, and then perform a cleaning operation to remove any tobacco material remaining in the aerosol generating device 100.

The aerosol generating device 100 may weaken the magnetic force generated by the magnetic force generator 160 such that the cover 120 and the case 110 are easily separable from each other. For example, the aerosol generating device 100 may stop magnetic force generation of the magnetic force generator 160.

The metallic body 180 and the magnetic force generator 160 may be arranged such that the coupling force between the cover 120 and the case 110 is effectively adjustable due to a change in the magnetic force. For example, the heater 130 may be arranged on one upper side of the case 110, and the magnetic force generator 160 may be arranged on the other upper side of the case 110. The metallic body 180 may be arranged on one side of the cover 120 facing the other upper side of the case 110 in which the magnetic force generator 160 is arranged.

Shapes and arrangements of the magnetic force generator 160 and the metallic body 180 are not limited to those illustrated in FIG. 2. According to an exemplary embodiment, the magnetic force generator 160 may be arranged to extend along an upper circumference of the case 110. In this case, the metallic body may be arranged to extend along a lower circumference of the cover.

According to an exemplary embodiment, the magnetic force generator 160 may be arranged such that the magnetic force is directed toward the metallic body 180, not toward the controller 140, to minimize the influence of the magnetic force on electronic elements. For example, the controller 140 may be arranged in the bottom portion of the case 110, and the magnetic force generator 160 may be arranged in the top portion of the case 110, such that the magnetic force may be directed upward.

The magnetic force generator 160 and the metallic body 180 may be designed in various shapes such as a rectangular shape, a circular shape, a ring shape, etc.

The case 110 may have a cigarette receiver 190 formed thereon. The heater 130 may be arranged in the cigarette receiver 190, and the heater 130 may heat a cigarette with an aerosol generating material mounted in the cigarette receiver 190.

The case 110 may have an insertion hole 112 formed in the cigarette receiver 190, and the cigarette may be inserted into the cigarette receiver 190 through the insertion hole 112.

The cover 120 may have an outer hole 122 aligned with the insertion hole 112 when the case 110 is coupled thereto. The cigarette can penetrate the cover 120 through the outer hole and reach the insertion hole 112 of the case 110.

The cover 120 and the case 110 may be formed of a plastic material that does not transfer heat well, or a metallic material having a heat blocking material coated on surfaces thereof. The cover 120 and the case 110 may be manufactured by using, for example, an injection molding method, a three-dimensional (3D) printing method, or a method of assembling small components manufactured by injection molding.

The shape of the heater 130 is not limited to the shape illustrated in FIG. 2, and the heater 130 may be manufactured in various shapes. For example, the heater 130 may include a tube-type heating element, a plate-type heating element, a needle-type heating element, or a rod-type heating element. The heater 130 may heat the inside or the outside of the cigarette according to the shape of the heating element.

Although only one heater 130 is illustrated in FIG. 2, the present disclosure is not limited thereto, and a plurality of heaters 130 may be arranged in the aerosol generating device 100. When the aerosol generating material is provided in the cigarette, the plurality of heaters 130 may be inserted into the inside of the cigarette or may be arranged outside the cigarette. Also, some of the plurality of heaters 130 may be inserted into the cigarette, and the others may be arranged outside the cigarette.

According to an exemplary embodiment illustrated in FIG. 2, the controller 140 and the battery 150 may be arranged under the case 110. The controller 140 and the battery 150 may extend in one direction, and may be arranged to extend along an extension direction of the case 110.

The battery 150 may be charged by receiving power from the outside through a terminal formed under the case 110.

The controller 140 may be electrically connected to the input unit 104 (refer to FIG. 10) arranged on a side surface of the case 110 to receive a user input.

FIG. 3 is a perspective view of an aerosol generating device in which a cover is coupled to a case, according to an exemplary embodiment.

Referring to FIG. 3, the cover 120 may cover a part or all of the cigarette receiver 190 of the case 110 when coupled to the case 110. The cigarette receiver 190 is a portion where the temperature rises because a heating operation of the heater 130 for the cigarette occurs therein. As the cover 120 covers the cigarette receiver 190, heat of the heater 130 is prevented from being transferred to the outside, and thus, a user can be prevented from being injured.

When the cover 120 is coupled to the case 110, the aerosol generating device may strengthen the magnetic force generated by the magnetic force generator 160 to strengthen the coupling force between the cover 120 and the case 110.

As the cover 120 is coupled to the case 110, a separation distance between the metallic body 180 and the magnetic force generator 160 may be shorter than that in a separated state.

According to an exemplary embodiment, the metallic body 180 and the magnetic force generator 160 may be spaced apart from each other by a certain distance without facing each other.

However, arrangements of the magnetic force generator 160 and the metallic body 180 are not limited to those illustrated in FIG. 3. According to an exemplary embodiment, when the cover 120 is coupled to the case 110, an area of the cover 120 where the metallic body 180 is arranged and an area of the case 110 where the magnetic force generator 160 is arranged may overlap each other.

Also, when the cover 120 is coupled to the case 110, the outer hole 122 of the cover 120 and the insertion hole 112 of the case 110 may be aligned. The cigarette may be inserted into the insertion hole 112 through the outer hole 122.

Although the cigarette may be inserted into the insertion hole 112 of the case 110 even when the cover 120 is separated, the cigarette may be fixed into the cigarette receiver 190 more firmly when the cover 120 is coupled.

According to an exemplary embodiment, a holding device (not shown) for maintaining coupling between the cover 120 and the case 110 may be installed between the cover 120 and the case 110. The holding device may include, for example, a protrusion and a groove. The coupled state between the cover 120 and the case 110 may be maintained by maintaining a state where the protrusion is inserted into the groove. The protrusion may be moved by a user pressing an operation button and separated from the groove.

According to an exemplary embodiment, a door which opens and closes the outer hole may be installed on an upper surface of the cover 120, and the door may slide along a rail installed on the upper surface of the cover 120.

Figure 4:
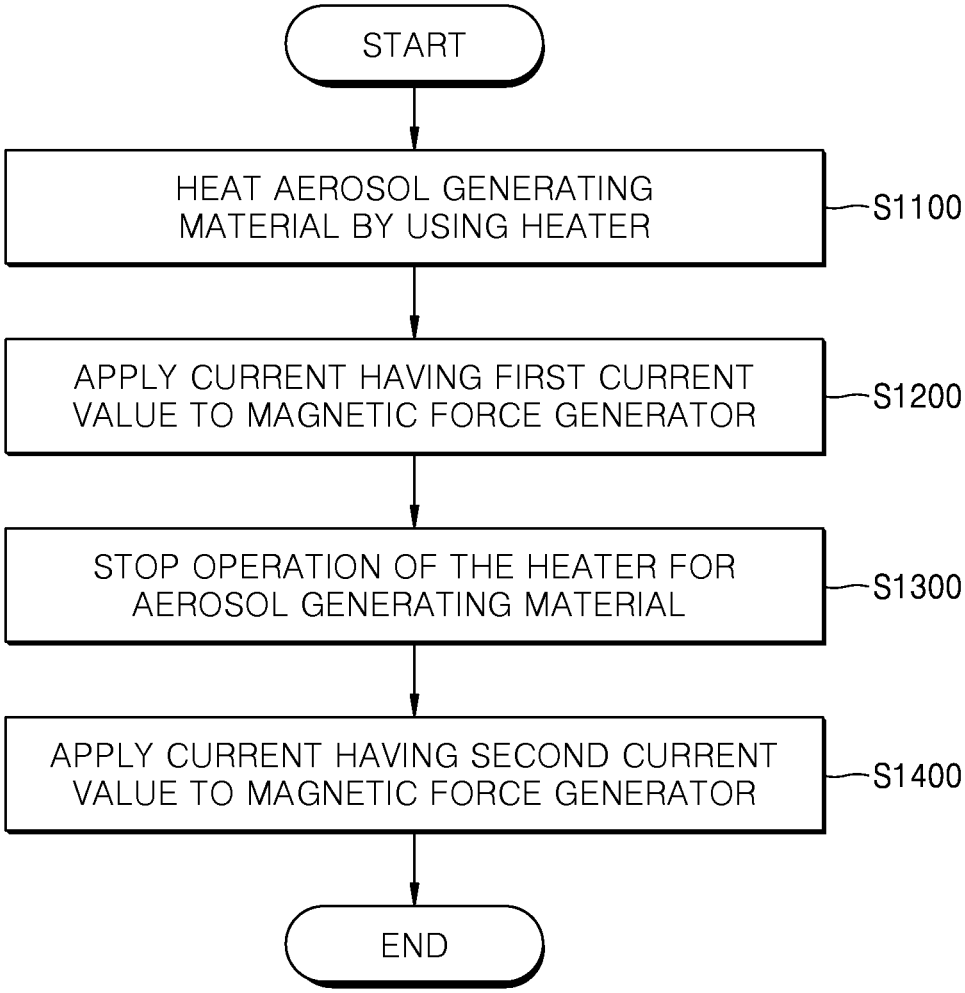
FIG. 4 is a flowchart of an operation method of an aerosol generating device according to an exemplary embodiment.

FIG. 4 is a flowchart of an operation method of an aerosol generating device according to an exemplary embodiment.

Referring to FIG. 4, the aerosol generating device 100 may heat the aerosol generating material by using the heater 130 (S1100). When the aerosol generating material is heated, the aerosol generating device 100 may apply a current having a first current value to the magnetic force generator 160 (S1200).

Accordingly, the magnetic force generator 160 may generate magnetic force corresponding to the first current value. The first current value may be a preset value that generates magnetic force required to strongly couple the cover 120 to the case 110 to keep them from being separated from each other. According to an exemplary embodiment, the first current value may be adjusted by the user, and thus, the coupling force may also be adjusted.

The coupling force between the cover 120 including the metallic body 180 and the case 110 including the magnetic force generator 160 may be strengthened by the magnetic force. The aerosol generating device 100 is configured to maintain the coupling force by continuously applying the current having the first current value. Accordingly, the cover 120 is strongly coupled to the case 110 during the heating operation, and thus, an accident in which the cover 120 is detached due to a user's inexperience may be prevented.

Thereafter, when a user's smoking is finished, the aerosol generating device 100 may stop the heating operation of the heater 130 for the aerosol generating material (S1300). When the heating operation is stopped, the aerosol generating device 100 may apply the current having the second current value to the magnetic force generator 160 (S1400).

According to an exemplary embodiment, the aerosol generating device 100 may stop the heating operation and apply the current having the second current value to the magnetic force generator 160 at substantially the same time.

The second current value may be a current value that generates magnetic force having a magnitude smaller than that of the magnetic force corresponding to the first current value. For example, the second current value may be smaller than the first current value. Accordingly, when the heating operation is stopped due to completion of smoking, the coupling force between the cover 120 and the case 110 may be weakened such that the cover 120 may be separated from the case 110 for cleaning, detachment of the cigarette, etc.

For example, the second current value may be greater than 0. The aerosol generating device 100 may weaken the coupling force between the cover 120 and the case 110 and maintain the coupling by continuously applying the second current value. Therefore, the state where the cover 120 is coupled to the case 110 may be maintained unless the cover 120 is removed by user's external force.

As another example, the second current value may be 0. In this case, the coupling force between the cover 120 and the case 110 may be mechanically provided by the holding device described above. Accordingly, the coupling force between the cover 120 and the case 110 may be continuously maintained, and power applied to the magnetic force generator 160 may be reduced.

According to the process described above, the aerosol generating device 100 may strengthen or weaken the coupling force between the cover 120 and the case 110 during the operating state of the heater 130 by differently adjusting the magnitude of the current applied to the magnetic force generator 160 according to the operating state of the heater 130.

Figure 5:
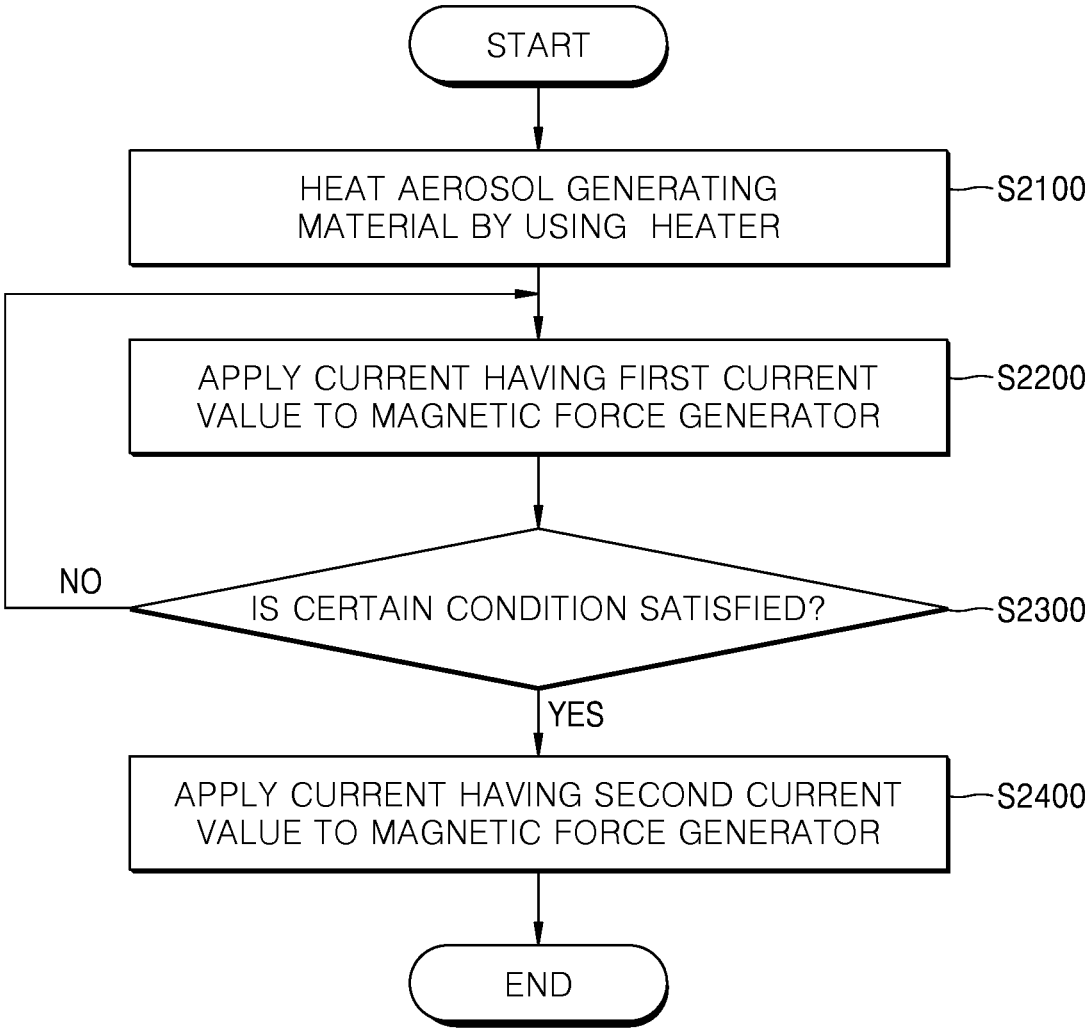
FIG. 5 is a flowchart of an operation method of an aerosol generating device according to another exemplary embodiment of the present application.

FIG. 5 is a flowchart of an operation method of an aerosol generating device according to another exemplary embodiment of the present application.

Referring to FIG. 5, the aerosol generating device 100 may heat the aerosol generating material by using the heater 130 (S2100). In this case, the aerosol generating device 100 may apply the current having the first current value to the magnetic force generator 160 (S2200). Accordingly, the coupling force between the case 110 and the cover 120 may be strengthened during the heating operation. Operation S2100 may be substantially the same as operation S1100. Operation S2200 may be substantially the same as operation S1200.

The aerosol generating device 100 may determine whether a certain condition is satisfied during the heating operation (S2300). The certain condition refers to a case where the cover 120 and the case 110 need to be made separable due to the completion of smoking, occurrence of an unexpected event, etc.

The certain condition may be that the number of a user's puffs exceeds a preset puff limit.

The puff limit may be the number of puffs corresponding to the maximum inhalation amount of the aerosol generating material in one smoking act. For example, the puff limit may be the number of puffs corresponding to an amount of the aerosol generating material contained in one cigarette, when calculated based on an inhalation amount of the aerosol generating in one puff.

The aerosol generating device 100 may stop the heating operation when a detected number of puffs exceeds the puff limit.

The certain condition may be, for example, that a time of the heating operation of the heater 130 exceeds a preset time limit.

The time limit may be a smoking time corresponding to the maximum inhalation amount of the aerosol generating material allowed in one smoking act. For example, the time limit may be a time required to inhale an amount corresponding to the aerosol generating material contained in one cigarette. The aerosol generating device 100 may stop the heating operation when the time limit elapses.

The certain condition may be, for example, that a user input for completing smoking is received through the input unit 104 (refer to FIG. 10).

The user may input the user input for completing smoking, for example, when the user no longer wants to smoke a cigarette according to his or her preference or when smoking needs to be stopped due to the occurrence of an unexpected event. The aerosol generating device 100 may stop the heating operation of the heater 130 when the user input is received.

The certain condition may be, for example, that, after a heating operation of the heater 130 is stopped, a temperature of the heater 130 descends to below a preset temperature limit.

The aerosol generating device 100 may maintain strong coupling force between the cover 120 and the case 110 until the temperature descends to below the temperature limit after heating. Thereafter, when a certain condition is satisfied because the temperature of the heater 130 is below the temperature limit, the aerosol generating device 100 may weaken the coupling force between the cover 120 and the case 110. Therefore, the aerosol generating device 100 may prevent the user from getting a burn, and may also prepare for a user's continuous smoking. This will be described later in more detail with reference to FIG. 6.

The certain condition may be, for example, that a preset standby time elapses after a heating operation of the heater 130 is stopped.

The aerosol generating device 100 may strengthen the coupling force between the cover 120 and the case 110 until the standby time elapses after the heating operation.

The temperature of the heater may rise during the heating operation and may descend after the heating operation.

Figure 6:
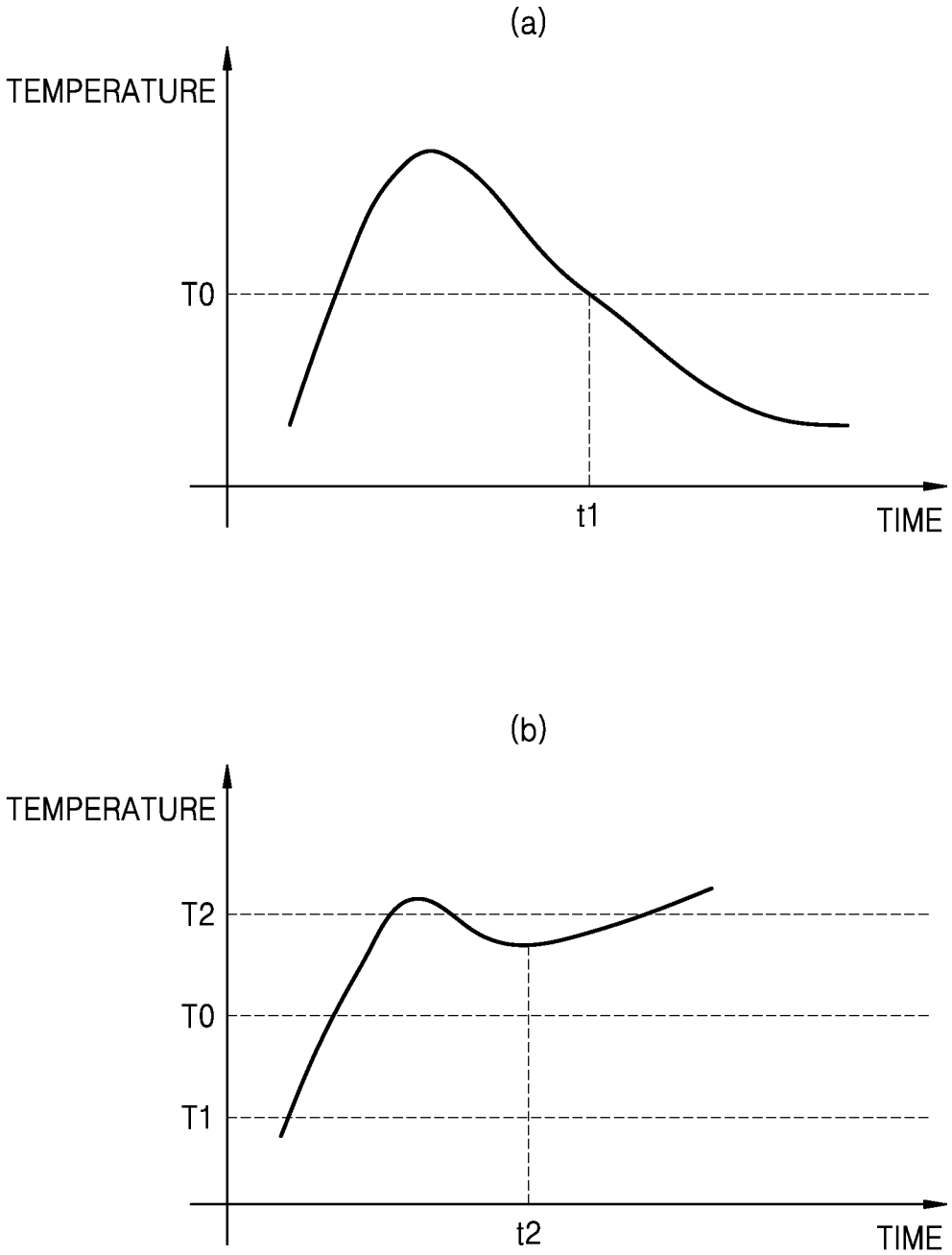
FIG. 6 shows graphs of heating temperature of an aerosol generating device according to an exemplary embodiment.

The standby time refers to a time required for the temperature of the heater 130 to descend to a safe temperature even when the cover 120 is separated from the case 110. The strengthened coupling force may be maintained for the standby time. Referring to FIG. 6, the standby time may be a time required for the temperature of the heater 130 to descend to a temperature limit T0 after the heating operation is stopped.

Alternatively, the standby time may be a time for standby in preparation for a reheat input of the user, for example, a time required for the user to replace the aerosol generating material. After the heating operation is stopped, the aerosol generating device 100 may maintain the strengthened coupling between the cover 120 and the case 110 until the aerosol generating material is replaced by the user for reheating. The reheating will be described later in more detail with reference to FIG. 6.

Accordingly, the aerosol generating device 100 may prevent the user from getting a burn, and may also maintain the coupled state between the cover 120 and the case 110 in preparation for a user's consecutive smoking.

When the certain condition is not satisfied, the aerosol generating device 100 may return to operation S2200 to apply the first current value to the magnetic force generator 160. When the certain condition is not satisfied, the coupling force between the cover 120 and the case 110 needs to be strengthened, and thus, the aerosol generating device 100 may apply the current having the first current value to the magnetic force generator 160, and may maintain the application of the current having the first current value.

The aerosol generating device 100 may apply the current having the second current value to the magnetic force generator 160 when the certain condition is satisfied (S2400).

When the certain condition is satisfied, the coupling force between the cover 120 and the case 110 needs to be weakened such that the cover 120 is separable from the case 110, and thus, the aerosol generating device 100 may apply the current having the second current value to the magnetic force generator 160. The second current value may have a magnitude smaller than that of the first current value. For example, the second current value may be 0.

When the condition is satisfied in a state where the heater 130 is operating, the aerosol generating device 100 may stop the operation of the heater 130 first and then may apply the second current value as the operation of the heater 130 is stopped. Accordingly, the inside of the case 110 may be prevented from being exposed by the cover 120 being separated therefrom while the heater 130 is in operation.

FIG. 6 shows graphs of heating temperature of an aerosol generating device according to an exemplary embodiment.

The aerosol generating device 100 may measure the temperature of the heater 130 by using a temperature sensor. Referring to FIG. 6A, the temperature of the heater 130 that rises for heating may descend after the heating operation is completed.

The certain condition described in operation S2300 of FIG. 5 may be that, after a heating operation of the heater 130 is stopped, the temperature of the heater 130 descends to below a preset temperature limit T0. In other words, the aerosol generating device 100 may apply the current having the first current value to the magnetic force generator 160 such that the coupling force between the cover 120 and the case 110 is strengthened until a first time point t1 at which the temperature of the heater 130 drops below the temperature limit T0. Accordingly, the aerosol generating device 100 may prevent the cover 120 from being separated from the case 110 when the temperature of the heater is higher than or equal to the temperature limit T0, and may prevent the user from getting a burn due to contact with the heater 130.

Thereafter, the temperature of the heater 130 may descend to below the temperature limit T0 at the first time point t1. At the first time point t1, the aerosol generating device 100 may apply the current having the second current value to the magnetic force generator 160 such that the cover 120 is separable from the case 110.

Referring to FIG. 6B, the aerosol generating device 100 may reheat the heater 130 after the heating operation is stopped, such that smoking is continuously performed.

As described with reference to FIG. 6A, after the heating operation is stopped, the temperature of the heater 130 may descend, and the aerosol generating device 100 may strengthen the coupling force between the cover 120 and the case 110 when the temperature of the heater 130 is higher than or equal to the temperature limit T0.

The aerosol generating device 100 may receive a reheat input from the user at a second time point t2 before the temperature of the heater 130 that descends is below the temperature limit T0. The aerosol generating device 100 may reheat the heater 130 starting from the second time point t2. In detail, the aerosol generating device 100 may begin to heat the heater 130 without a separate down time for waiting until the heater 130 is cooled down to a room temperature T1 at the second time point t2.

In this case, because the temperature of the heater 130 is higher than or equal to the temperature limit T0, the aerosol generating device 100 may maintain the application of the current having the first current value, and the coupling force between the cover 120 and the case 110 may be maintained in a strengthened state.

Accordingly, because a temperature at the second time t2 when the heater 130 begins to be reheated is higher than the room temperature T1, when reheating, the amount of power required to reach a maximum temperature T2 needed to generate aerosol may be greatly reduced, and the time required to reach the maximum temperature T2 may be shortened, as compared to the first heating.

On the other hand, when the temperature of the heater 130 drops below the temperature limit T0 without receiving the reheat input, the aerosol generating device 100 may apply the current having the second current value smaller than the first current value to the magnetic force generator 160 to weaken the coupling force and facilitate separation of the cover 120 and the case 110.

Figure 7:
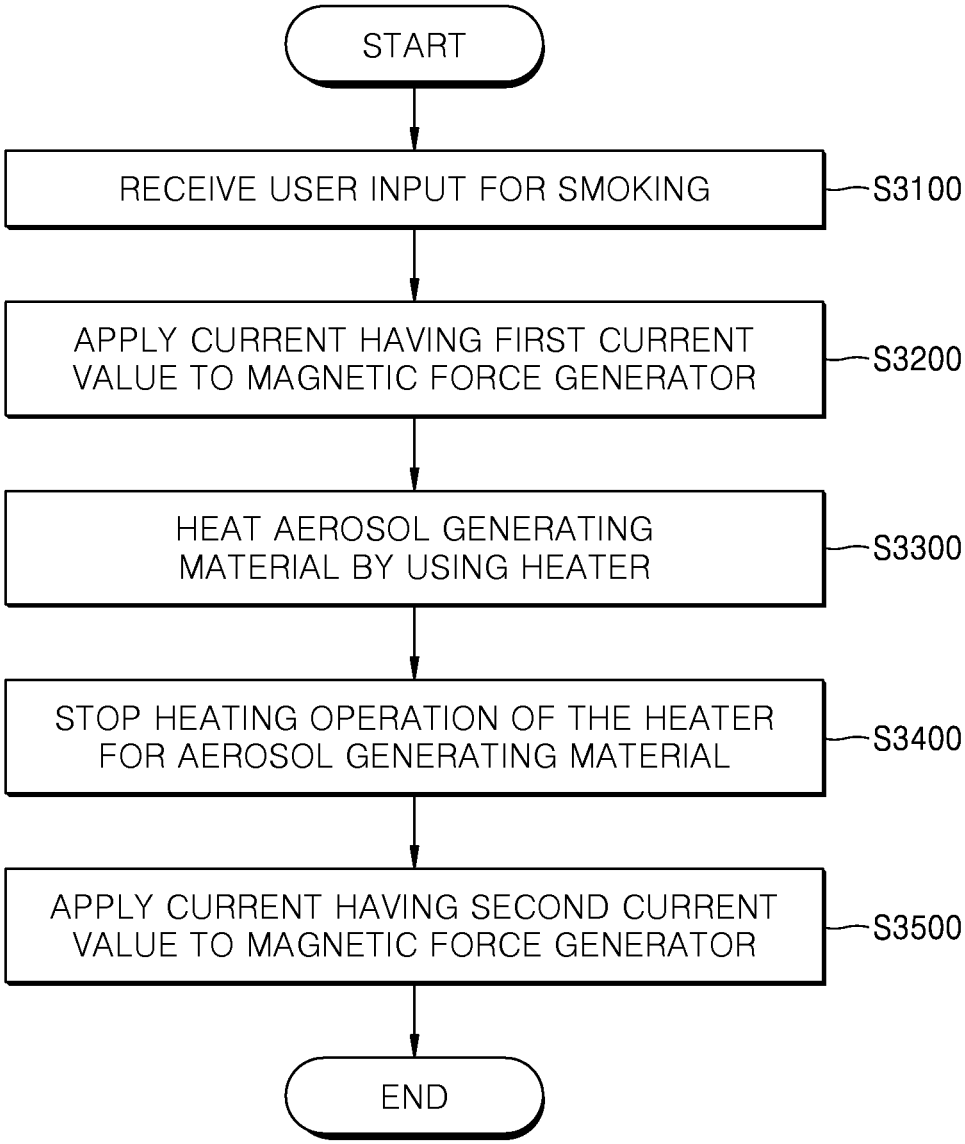
FIG. 7 is a flowchart of an operation method of an aerosol generating device according to another exemplary embodiment of the present application.

FIG. 7 is a flowchart of an operation method of an aerosol generating device according to another exemplary embodiment of the present application.

Referring to FIG. 7, the aerosol generating device 100 may receive a user input for smoking (S3100). For example, the aerosol generating device 100 may receive the user input for smoking through the input unit 104 (refer to FIG. 10) arranged on an external surface of the case.

The aerosol generating device 100 may apply the current having the first current value to the magnetic force generator 160 (S3200). Accordingly, when the aerosol generating device 100 receives the user input, the coupling force between the cover 120 and the case 110 may be strengthened. The aerosol generating device 100 continuously applies the current having the first current value to maintain the coupling force.

The descriptions explained in operation S1200 may be applied to operation S3200.

The aerosol generating device 100 may heat the aerosol generating material by using the heater 130 (S3300). The aerosol generating device 100 may strengthen the coupling force between the cover 120 and the case 110, and then may start the heating operation of the heater 130.

According to an exemplary embodiment, the aerosol generating device 100 may apply the current having the first current value to the magnetic force generator 160 and start the heating operation of the heater 130 at substantially the same time.

The aerosol generating device 100 may continue to apply the current having the first current value to the magnetic force generator 160 during the heating operation.

The descriptions explained in operation S1100 may be applied to operation S3300.

The aerosol generating device 100 may stop the heating operation of the aerosol generating material by using the heater 130 (S3400). Thereafter, the aerosol generating device 100 may apply the current having the second current value to the magnetic force generator 160 (S3500).

According to an exemplary embodiment, the aerosol generating device 100 may stop the heating operation and apply the current having the second current value to the magnetic force generator 160 at substantially the same time.

Accordingly, the cover 120 and the case 110 may be separable after the heating operation is stopped, and safety may be improved.

The descriptions explained in operations S1300 and S1400 may be applied to operation S3500.

Figure 8:
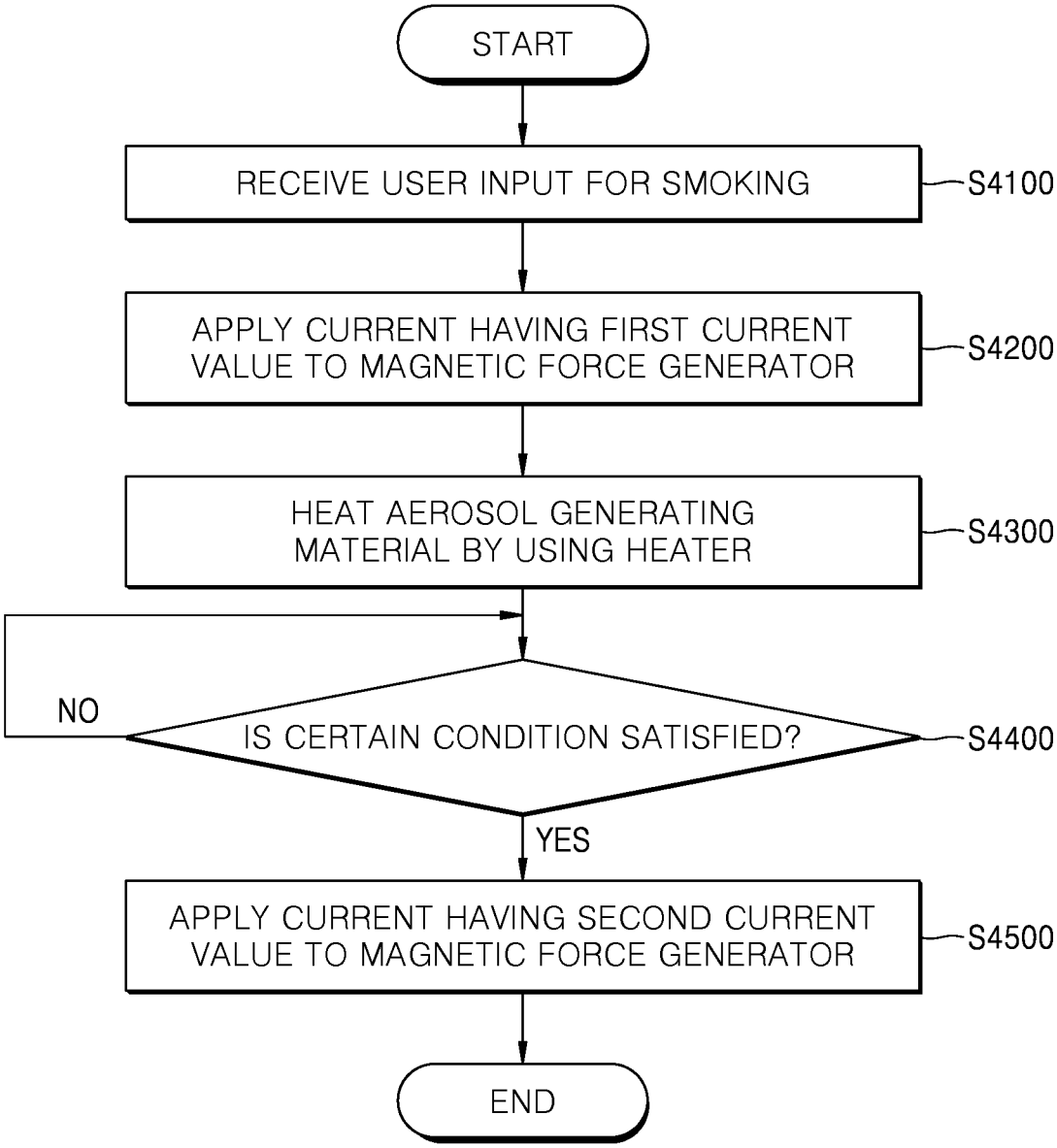
FIG. 8 is a flowchart of an operation method of an aerosol generating device according to another exemplary embodiment of the present application.

FIG. 8 is a flowchart of an operation method of an aerosol generating device according to another exemplary embodiment of the present application.

Referring to FIG. 8, the aerosol generating device 100 may receive a user input for smoking (S4100). Operation S4100 may be substantially the same as operation S3100.

The aerosol generating device 100 may apply the current having the first current value to the magnetic force generator 160 (S4200). Accordingly, the aerosol generating device 100 may strengthen the coupling force between the cover 120 and the case 110 before the heating operation is started, and thus, safety can be promoted.

The aerosol generating device 100 may heat the aerosol generating material by using the heater 130 (S4300). The aerosol generating device 100 may start the heating operation when the coupling force between the cover 120 and the case 110 is strengthened. The aerosol generating device 100 may continue to apply the current having the first current value to the magnetic force generator 160 during the heating operation.

The aerosol generating device 100 may determine whether a certain condition is satisfied (S4400). The certain condition may be that the cover 120 and the case 110 need to be made separable, and may be the same as the condition described in operation S2300. The descriptions explained in operation S2300 may be applied to operation S4400.

When the condition is not satisfied, the aerosol generating device 100 may continuously apply the current having the first current value to the magnetic force generator 160 to maintain the strengthened coupling force.

When the condition is satisfied, the aerosol generating device 100 may apply the current having the second current value to the magnetic force generator 160 (S4500). If the heater 130 is in operation, the aerosol generating device 100 may weaken the coupling force between the cover 120 and the case 110 after the operation of the heater 130 is stopped. The descriptions explained in operation S2400 may be applied to operation S4500.

Figure 9:
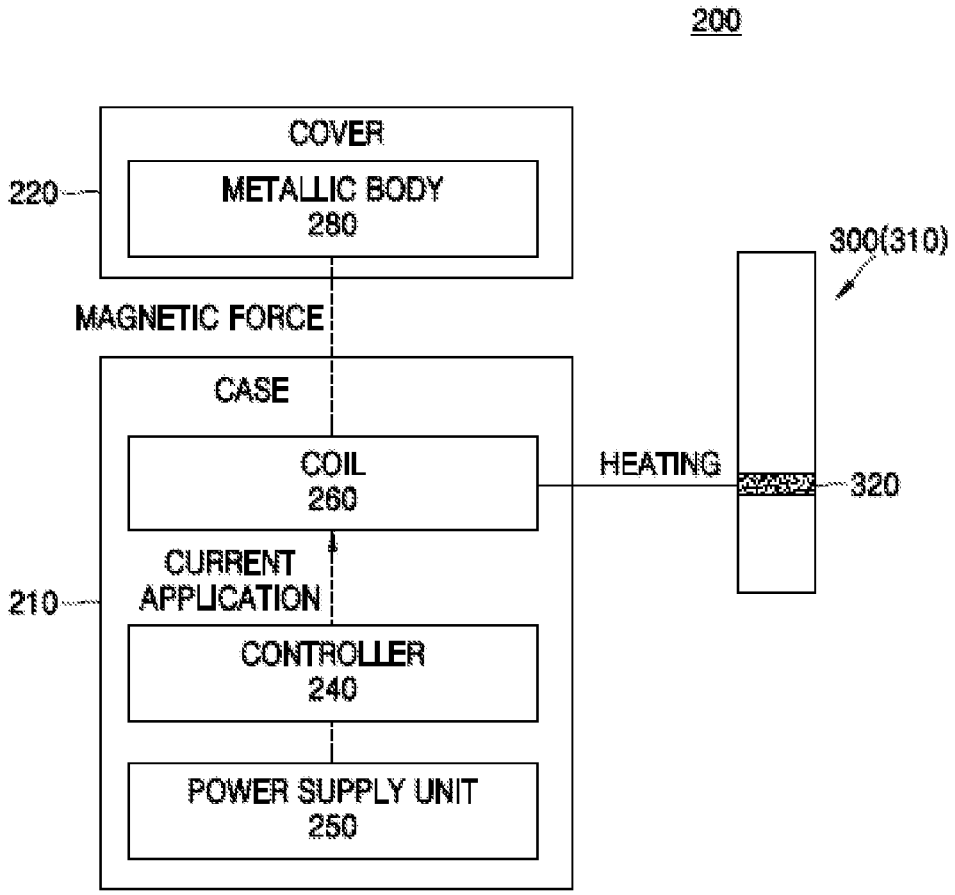
FIG. 9 is a block diagram of an aerosol generating device according to another exemplary embodiment of the present application.

FIG. 9 is a block diagram of an aerosol generating device according to another exemplary embodiment of the present application.

Referring to FIG. 9, an aerosol generating device 200 may include a case 210, a cover 220, a coil 260, a power supply source 250, a controller 240, and a metallic body 280 provided in the cover 220.

The descriptions explained about the aerosol generating device 100 of FIG. 1 may be applied to the aerosol generating device 200 of FIG. 9.

A cigarette or liquid cartridge 300 including an aerosol generating material 310 may include a susceptor 320 therein. The susceptor 320 may be arranged to be adjacent to or in contact with the aerosol generating material 310. The susceptor 320 may be heated by an eddy current induced from the coil 260 and may heat the aerosol generating material 310 by transferring heat to the aerosol generating material 310. The cigarette or liquid cartridge 300 including the aerosol generating material 310 may be inserted into the case 210 to be located adjacent to the coil 260.

The coil 260 may be provided in the case 210.

The coil 260 may generate magnetic force by receiving a current. The coil 260 may apply the magnetic force to the metallic body 280 to change the coupling force between the cover 220 and the case 210. The controller 240 may adjust the coupling force between the cover 220 and the case 210 by adjusting characteristics of a current applied to the coil 260. For example, the controller 240 may adjust a magnitude of the current applied to the coil 260. The current applied to the coil 260 to generate magnetic force may be a direct current or an alternating current.

Also, the coil 260 may receive a current and induce an eddy current in the susceptor 320 to heat the aerosol generating material. To this end, the coil 260 may receive an alternating current having a direction alternately changed from the power supply source 250. The controller 240 may control a heating operation, a heating time, a heating intensity, and the like by adjusting properties of a current applied to the coil 260.

The power supply source 250 may supply a direct current or an alternating current to the coil 260. According to an exemplary embodiment, the power supply source 250 may include a battery which supplies direct current power and an adaptor which converts a direct current from the battery into an alternating current. However, the power supply source 250 is not limited thereto.

The controller 240 may heat the susceptor 320 and the aerosol generating material through the susceptor 320 by adjusting the current applied to the coil 260. The controller 240 may generate magnetic force by adjusting the current applied to the coil 260 according to a user input or a certain condition, and thus, the coupling force between the cover 220 and the case 210 may be increased.

The controller 240 may adjust the coupling force between the cover 220 and the case 210 by using the magnetic force, based on whether the coil 260 heats the susceptor 320 and the aerosol generating material. For example, when the susceptor 320 is heated through the coil 260, the controller 240 may strengthen the magnetic force through the coil 260 such that the coupling force between the cover 220 and the case 210 is strengthened. Also, when the susceptor 320 is not heated, the controller 240 may weaken the magnetic force or stop generating the magnetic force through the coil 260, such that the cover 220 and the case 210 are separable from each other due to the weakened coupling force therebetween.

The aerosol generating device 200 of FIG. 9 may perform the operation of the aerosol generating device 200 described with reference to FIGS. 4 through 8, and in this case, the coil 260 may serve as a magnetic force generator 160 and a heater 130. Accordingly, the aerosol generating device 200 may be further miniaturized and may save power by using the coil 260.

Although the configuration and features of the present disclosure are described based on the exemplary embodiments of the present disclosure, the present disclosure is not limited thereto. It will be obvious to those of ordinary skill in the art that the present disclosure may be variously changed or modified within the scope of the present disclosure, and thus, such changes or modifications are within the appended claims.

What is claimed is:

1. An aerosol generating device comprising:

a case;

a cover having a metallic body and configured to be coupled to the case;

a heater configured to heat an aerosol generating material;

a magnetic force generator arranged in the case and configured to generate magnetic force acting on the metallic body according to a current applied thereto; and a controller configured to adjust coupling force between the cover and the case, which is generated by the magnetic force, by controlling the current applied to the magnetic force generator based on an operating state of the heater.

2. The aerosol generating device of claim 1, wherein the controller is configured to control the current applied to the magnetic force generator to strengthen the coupling force, based on the heater heating the aerosol generating material.

3. The aerosol generating device of claim 1, wherein the controller is configured to control the current applied to the magnetic force generator to weaken the coupling force, based on the heater not heating the aerosol generating material.

4. The aerosol generating device of claim 1, wherein the controller is configured to:

apply a current having a first current value to the magnetic force generator, based on the heater heating the aerosol generating material, and apply a current having a second current value smaller than the first current value to the magnetic force generator, based on the heater not heating the aerosol generating material.

5. The aerosol generating device of claim 4, wherein the second current value is 0.

6. The aerosol generating device of claim 1, further comprising an input unit configured to receive a user input for generating aerosol, wherein the controller is configured to, according to the user input received through the input unit, operate the heater after applying the current to the magnetic force generator.

7. The aerosol generating device of claim 1, wherein the controller is configured to stop applying the current to the magnetic force generator to facilitate separation of the cover and the case, based on a preset condition being satisfied.

8. The aerosol generating device of claim 7, further comprising a puff sensor configured to sense a user's puffs, wherein the preset condition is that the number of a user's puffs, detected through the puff sensor, exceeds a preset puff limit.

9. The aerosol generating device of claim 7, wherein the preset condition is that a time of a heating operation of the heater exceeds a preset time limit.

10. The aerosol generating device of claim 7, further comprising an input unit configured to receive a user input, wherein the preset condition is that a user input for stopping heating is received through the input unit.

11. The aerosol generating device of claim 7, further comprising a temperature sensor configured to measure a temperature of the heater, wherein the preset condition is that, after a heating operation of the heater is stopped, a temperature of the heater descends to below a preset temperature limit.

12. The aerosol generating device of claim 7, wherein the preset condition is that a preset standby time elapses after a heating operation of the heater is stopped.

13. The aerosol generating device of claim 1, wherein the heater is arranged on one upper side of the case, the magnetic force generator is arranged on another upper side of the case, and the metallic body is provided on one side of the cover which faces the other upper side of the case when the cover is coupled to an upper portion of the case.

14. The aerosol generating device of claim 1, wherein the magnetic force generator comprises a coil, and the coil is configured to inductively heat an aerosol generating material or generate magnetic force acting on the metallic body according to a current applied to the coil, and the controller is configured to adjust coupling force between the cover and the case by the magnetic force and a heating state of the aerosol generating material, by controlling the current applied to the coil.

15. An operation method of an aerosol generating device comprising a case and a cover couplable to the case, wherein the aerosol generating device comprises a metallic body provided in the cover and a magnetic force generator provided in the case and configured to generate magnetic force acting on the metallic body according to a current applied thereto, and wherein the operation method comprises:

strengthening coupling force between the cover and the case by applying a first current to the magnetic force generator, based on an aerosol generating material being heated; and weakening the coupling force by applying a second current smaller than the first current to the magnetic force generator, based on the aerosol generating material not being heated.

* * * * *